United States Patent [19]

Cormier

[11] 4,387,981

[45] Jun. 14, 1983

[54] SHEET STRIPPING APPARATUS AND METHOD

[75] Inventor: Raymond G. Cormier, Nashua, N.H.

[73] Assignee: Nashua Corporation, Nashua, N.H.

[21] Appl. No.: 219,511

[22] Filed: Dec. 23, 1980

[51] Int. Cl.[3] ..... G03G 15/00

[52] U.S. Cl. ..... 355/3 SH; 271/DIG. 2

[58] Field of Search ..... 355/3 SH; 271/DIG. 2, 271/307, 308, 311

[56] References Cited

U.S. PATENT DOCUMENTS

| | | | |
|---|---|---|---|
| 3,450,402 | 6/1969 | Weiler | 271/80 |
| 3,578,859 | 5/1971 | Stillings | 355/3 |
| 3,649,115 | 3/1972 | Hodges | 355/11 |
| 3,820,776 | 6/1974 | Fujimoto et al. | 271/80 |
| 3,885,786 | 5/1975 | Schmalzbauer | 271/174 |
| 3,936,045 | 2/1976 | Ariyama | 271/311 |
| 3,991,999 | 11/1976 | Brooke | 271/174 |
| 3,992,000 | 11/1976 | Martin | 271/174 |
| 4,000,942 | 1/1977 | Ito et al. | 355/3 R |
| 4,072,307 | 2/1978 | Knieser | 271/174 |
| 4,159,172 | 6/1979 | Tani et al. | 271/DIG. 2 |
| 4,244,648 | 1/1981 | Schultes | 271/311 X |
| 4,269,504 | 5/1981 | Landa | 271/DIG. 2 |
| 4,278,341 | 7/1981 | Burgess et al. | 271/DIG. 2 |

*Primary Examiner*—R. L. Moses

*Attorney, Agent, or Firm*—Lahive & Cockfield

[57] ABSTRACT

A sheet stripping apparatus and method used in a photocopying machine employ a resiliently biased sheet stripping element in contact with the photosensitive surface of the copier for detaching a leading edge of a copy sheet as it moves toward the sheet stripping assembly. A moving deflection surface, such as a knurled roller, is positioned immediately adjacent the operative portion of the sheet stripping element for deflecting the detached leading edge of the copy sheet away from the sheet stripping element and toward an exit path. A friction roller in juxtaposition to the deflection surface provides a nip for grabbing the copy sheet and directing it along the exit path. The friction roller is preferably driven at a velocity greater than the velocity of the photosensitive surface.

19 Claims, 6 Drawing Figures

SHEET STRIPPING APPARATUS AND METHOD

BACKGROUND OF THE INVENTION

The invention relates generally to photocopiers and in particular to a method and apparatus for stripping sheets from a fragile photosensitive surface after transfer of a developed image from the surface to a copy sheet.

A photocopier employs a moving photosensitive surface which is electrically charged and exposed to an energy image, most often a light energy pattern generated by scanning an original document. The energy is focused on the charged surface to form a latent electrostatic image thereon. The latent image is developed, and the developed image is transferred to a copy sheet of transfer material brought into intimate contact with the surface portion bearing the developed image. The sheet is then stripped from the photosensitive surface and transported away from the surface along an exit path. A fixing or fusing station is typically provided along the exit path.

The copy sheet, when it is brought into contact with the photosensitive surface, ordinarily adheres tightly to it due to the electrostatic fields created during the photocopying and transfer processes and, in the case of liquid developer copiers, also because of the surface tension created by the liquid developer. The sheet must be stripped from the surface with a minimum of disturbance to the generally fragile developed image and with minimum or no damage to the fragile photosensitive surface. One commercially available dry copier directs a short-duration stream of air between the copy sheet and the photosensitive surface to separate the leading edge of the copy sheet so that it can be either later gripped or allowed to fall away from the photosensitive surface. The copy sheet is then conveyed to a fixing or fusion station. The air puffing method has the disadvantage of potentially disturbing the toner particles adhering to the copy sheet and of being very sensitive to the system operating parameters. Also it does not operate satisfactorily with liquid developer systems.

There also exist many different apparatus wherein a mechanical member makes actual contact with the fragile photosensitive surface. The member can be in constant contact with the surface, or to reduce the likelihood of damage to the surface, can be brought into timed engagement with the photosensitive surface. In either instance, the stripped paper is allowed to "fall" onto a conveyor system for removal to an exit station or is directed to rollers spaced some distance away from the surface. This apparatus has the disadvantage of potentially marring the image and, where movement is timed to the copy sheet, of requiring the device to be properly timed and precisely positioned so that it does not mar the photosensitive surface or the fragile image and so that sheet pick-off is reliably accomplished.

Another method, particularly useful in connection with liquid developer photocopiers and described more fully in U.S. Pat. No. 4,000,942, provides for a stripping assembly having an elongated blade member in contact with a marginal edge of the photosensitive surface. When the copy sheet is fed toward the photosensitive surface, a marginal edge of the copy sheet slides along the stripping blade member. The member directs a forward portion of a leading edge of the copy sheet to engagement with a roller nip. A disadvantage of this approach is that an entire marginal edge of the copy sheet is prevented from contacting the photosensitive surface and is therefore unavailable for copying. The pressure of the member against the photosensitive surface also can wear or damage the surface.

It is therefore a principal object of this invention to minimize interference with the photocopying process and reduce potential smudging or smearing of the copy sheet image. It is another important object of the invention to maximize the amount of copy sheet surface available for copying. A further object of the invention is a sheet stripping apparatus which is reliable, durable, simple in construction, simple to install, and substantially maintenance free. A yet further object of the invention is a sheet stripping apparatus and method which can be particularly employed in liquid developer copiers.

SUMMARY OF THE INVENTION

The invention relates to a method and apparatus for removing copy sheet material from the photosensitive surface in a photocopying apparatus. The photocopying apparatus has a moving member having a photosensitive surface, elements for forming a developed image on the photosensitive surface, and a sheet feeding apparatus for feeding copy sheet material for contact with the photosensitive surface at a transfer station where transfer of the developed image onto the copy sheet material is accomplished.

The sheet removing assembly features a sheet stripping element having an operative portion resiliently biased against the photosensitive surface for contacting a leading edge of the copy sheet as it moves toward the sheet stripping element, and for detaching that leading edge of the copy sheet from the photosensitive surface. The assembly further features a first movable deflection surface which has a surface portion closely adjacent the operative portion of the sheet stripping element and in the path of the detached leading edge for deflecting the detached edge away from the sheet stripping element and preferably toward a second movable friction surface. The invention further features drive elements for driving at least one of the first and second movable surfaces for directing the copy sheet material toward an exit path away from the photosensitive surface.

In another aspect, the invention relates to a method for removing copy sheet material from the photosensitive surface of a photocopying apparatus. The apparatus has elements for forming a developed image on the photosensitive surface, feed members for feeding a copy sheet material for contact with the photosensitive surface at a transfer station whereat the developed image is transferred to the copy sheet material, and sheet removal elements for removing the transfer sheet from the photosensitive surface. This aspect of the invention features the steps of resiliently biasing a sheet stripping member at an operative portion thereof against the photosensitive surface for contacting a leading edge of the copy sheet as it moves toward the sheet stripping element. The method further features detaching the leading edge of the copy sheet material from the photosensitive surface using the operative portion of the sheet stripping element and positioning a movable deflection surface adjacent the operative portion of the sheet stripping element for substantially immediately deflecting and maintaining the detached leading edge of the sheet material away from the sheet stripping element and toward the exit path. The method further features driving the moving deflection surface, for deflecting the copy sheet material away from the photosensitive surface, preferably at a velocity greater than the peripheral velocity of the photosensitive surface. Thus, the sheet is deflected away from the photosensitive surface, away from the stripping member, and toward the exit path.

BRIEF DESCRIPTION OF THE DRAWINGS

Other objects, features and advantages of the invention will appear from the following description of particular preferred embodiments thereof and the drawings, in which.

DESCRIPTION OF PARTICULAR PREFERRED EMBODIMENTS

Figure 1:
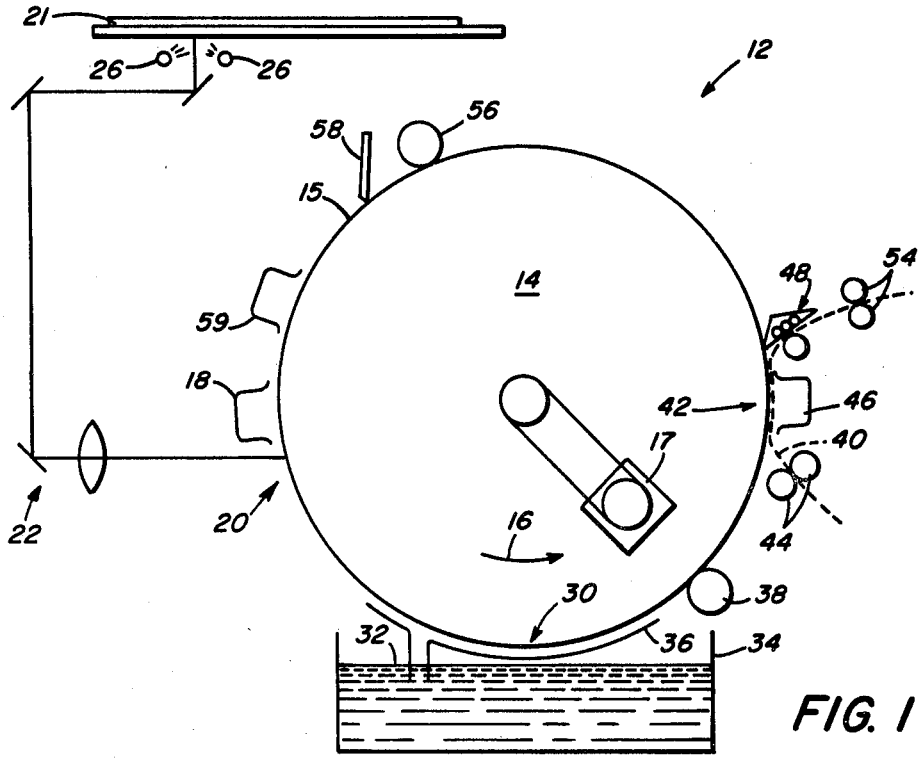
FIG. 1 is a schematic front elevation view of a photocopier in which the present invention is incorporated.

Referring to FIG. 1, the invention is described in association with a liquid developer photocopier 12 having a rotatable drum 14 with a photosensitive surface 15 thereon. The invention is equally adaptable to dry developer apparatus and to non-drum apparatus such as belt configuration type copiers; however, in dry developer apparatus, the absence of the liquid developer as a lubricant for the photosensitive surface sheet removal assembly, as described below, may decrease photoconductor life. The illustrated drum has a photosensitive selenium surface layer deposited on an aluminum substrate, and is rotated in the counterclockwise direction as indicated by the arrow 16, by a drive motor 17. A charge corona 18 charges the drum photosensitive surface 15 to about +1000 volts D.C. The charged drum surface 15 is exposed to an image at an exposure station 20. In the illustrated embodiment, the image is transmitted to the drum through a lens/mirror optical arrangement 22 from a document 24 illuminated by lamps 26.

The image is focused on the drum photosensitive surface 15 and thereupon the charge on the drum surface progressively forms an electrostatic latent image. The electrostatic latent image on the drum surface is brought to a development station 30 where a liquid developer 32, having negatively charged toner particles, contacts the electrostatic image to develop the image. The illustrated development station 30 includes a developer tank 34 and a development electrode 36. Developer 32 is introduced between the development electrode and the drum surface 15 to develop the electrostatic image. The drum surface 15, now wetted and carrying the developed image, is moved past a metering roll 38 which controls and limits the thickness of the liquid developer on the drum surface.

A copy sheet material 40 is fed toward the drum surface 15 to a transfer station 42. The sheet 40 is conveyed to the surface by, inter alia sheet registration rollers 44, as is well known, and contacts the drum surface, here, just before a transfer corona 46. A positive charge from the transfer corona 46 is applied to copy sheet material 40, causing the transfer of toner particles from the developed image on the drum's surface 15 to the copy sheet 40. The sheet 40 is stripped off the drum surface by a pick-off assembly 48, according to the invention, which directs the copy sheet 40 along an exit path to driven rollers 54. Rollers 54 transport the sheet toward a heating element for fixing the wet liquid image and then toward a copy receiving tray (not shown).

After transfer, there remains on the drum surface an undesirable residue of liquid that is removed by a surface contacting cleaning roller 56 and a cleaning blade 58. After cleaning, and prior to the next charging step, the drum surface is electrically neutralized by a high voltage A.C. neutralizing charge from a corona 59.

Figure 3:
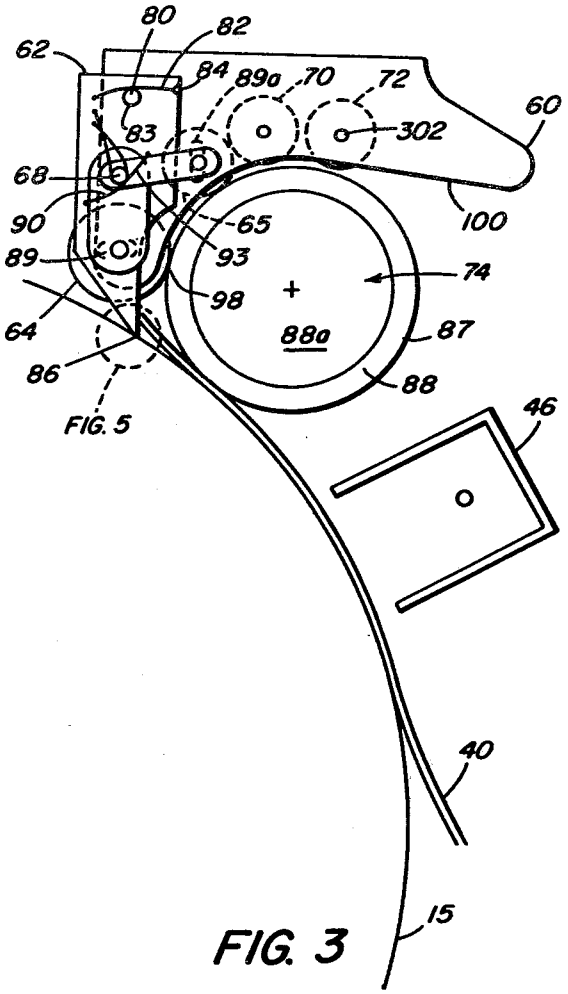
FIG. 3 is an elevation view of the photosensitive surface and sheet stripping apparatus according to the invention with the copy sheet just having been picked off the photosensitive surface at its leading edge.
Figure 2:
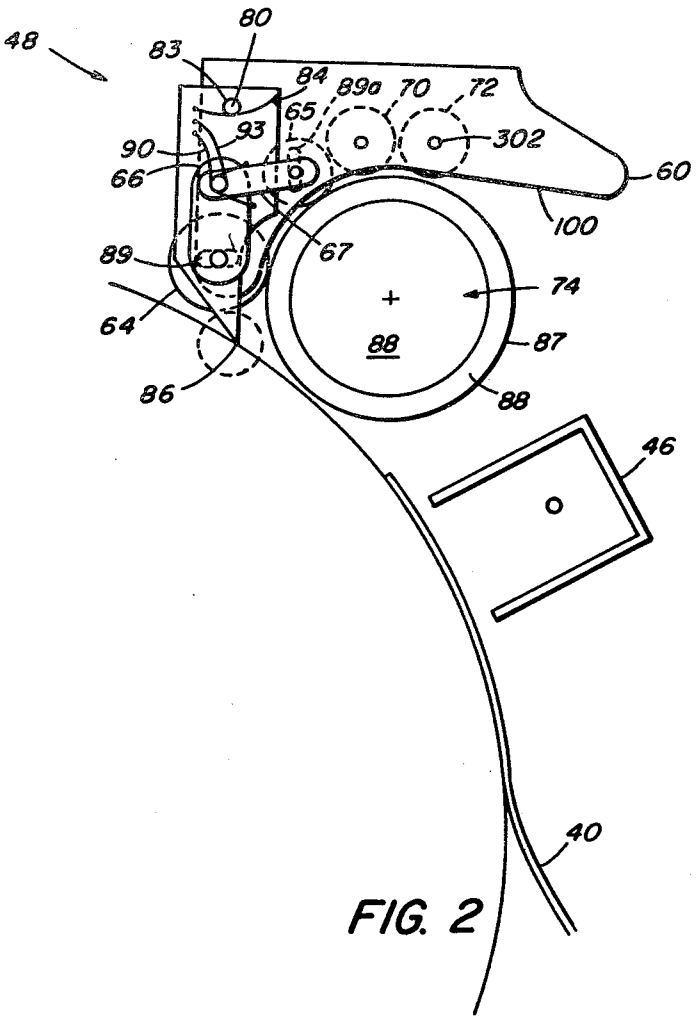
FIG. 2 is an elevation view of the photosensitive surface and sheet stripping apparatus according to the invention with the copy sheet at the transfer station.
Figure 4:
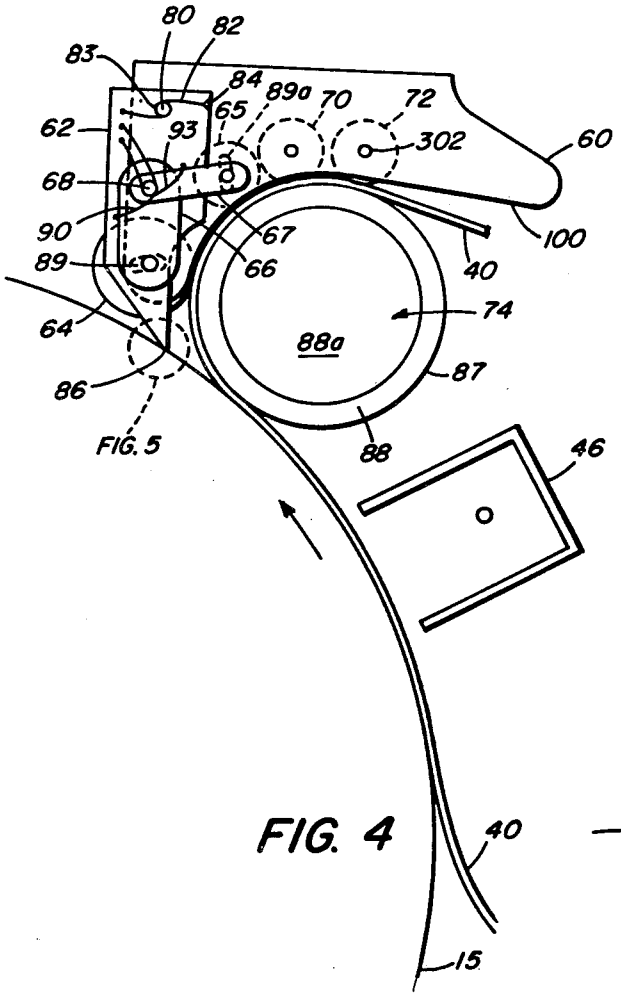
FIG. 4 is an elevation view of the photsensitive surface and sheet stripping apparatus according to the invention with the copy sheet on its way along the exit path.

Referring to FIGS. 2–4, the illustrated pick-off assembly 48 has a planar mounting plate bracket member 60 affixed to the machine frame and on which are mounted a resiliently biased pivoting stripping element 62, first and second resiliently biased knurled rollers 64 and 65 connected respectively by link members 66, 67 for movement about the same pivot axis 68, and a third and a fourth positionally fixed knurled rollers 70 and 72 respectively. The knurled rollers 64 and 65 are resiliently biased against a rubber coated driven roller 74, and knurled rollers 70 and 72 are positionally spaced apart from the roller 74.

In the illustrated embodiment, element 62 is a planar element mounted for pivoting movement in a plane substantially normal to the axis of the rotating drum, i.e. aligned with the direction of movement of the photosensitive surface at their point of contact. Similarly, in the illustrated embodiment, the axes of rotation of the rollers are parallel to each other and to the pivot axis 68.

In its normal operating position, stripping element 62 resiliently engages the photosensitive surface 15 of drum 14. The stripping element 62 is resiliently pivoted about a pivot axis 80 under the influence of a spring element 82. Spring element 82 connects at one end to mounting bracket 60, is coiled around a shoulder screw 83, and rests at a second end in a groove 84 in element 62. The stripping element 62 is thus biased, in FIG. 2, in a clockwise direction around pivot axis 80 which brings a tip 86 of stripping element 62 into operative resilient engagement with the photosensitive surface 15. The pressure of tip 86 against surface 15 is thus controlled by the spring element 82.

Rollers 70 and 72 are fixed in position as noted above, and are precisely mounted on plate 60 so as to be spaced apart from the surface 87 of roller 74. Illustrated roller 74 has a rubber coating 88 on a metal core 88*a*. Illustrated knurled rollers 64 and 65 are, as noted above, resiliently biased, for independent movement relative to roller surface 87. Each of rollers 64 and 65 is guided by a slot 89 and 89*a*, respectively, in mounting plate 60. A resilient bias is applied to roller 64 by the action of a resilient spring 90 which is secured between the bracket member 60 and connection link 66. Rotation of connecting link 66 translates roller 64 in slot 89 about pivot axis 68. Similarly roller 65 is biased toward roller surface 87 by a resilient spring 93 secured between bracket 60 and connecting link 67. Rotation of connecting link 67 moves roller 65 in slot 89*a* about pivot axis 68. Rollers 64 and 65 are driven by roller 74. All of the knurled rollers 64, 65, 70, and 72 are preferably of a medium knurl (21 pitch), standard face, and are commercially available.

Roller 74 is driven at a substantially constant speed by a connection to the drive system for the drum member. Preferably, the drive connection is adjusted so that roller surface 87 has a peripheral velocity just greater than that of the drum photosensitive surface 15. For example, the photosensitive surface velocity can be 492 inches per minute and the velocity of the surface 87 can be 516 inches per minute. (If the peripheral velocity of roller surface 87 is about equal to the velocity of the photosensitive surface, some buckling can occur along with smudging of the image.) However, in a second particular embodiment of the invention, as described below, the peripheral velocity of the roller surface 87 is selected to be substantially greater than that of the drum surface 15 to ensure that a copy sheet member is drawn away from stripping element 62 after a leading edge of the copy sheet element is captured by the roller 64 - roller 74 nip after removal from the photosensitive surface. In this latter embodiment, the roller 74 is driven through, for example, a slip clutch to ensure that sheet material is not removed from the drum prior to image transfer. Thus, the sheet material leading edge is driven at an initial velocity substantially greater than the velocity of photosensitive surface; and after the "slack" is taken up, the sheet material leading edge velocity decreases to about that of the photosensitive surface. Also in this latter embodiment there is more freedom in setting the location of roller 64 relative to tip 86.

Thus, in normal operation according to the invention, the stripping element tip 86 gently rests on the photosensitive surface 15 of the drum under the influence of spring biasing member 82. Therefore, in the illustrated embodiment, the pressure of the element tip 82 against the drum surface is easily and independently controlled. Furthermore, the stripping element 62 is configured so that the tip 86 rests on the photosensitive surface at its end (see FIG. 5) to more easily strip a copy sheet adhering to the drum surface. Illustrated element 62 is a planar mylar member having a thickness of 0.012 inches, lies in a plane substantially normal to the photosensitive surface, and preferably rests against surface 15 with a force approximately between fifteen and twenty grams. In other embodiments, element 62 could be made of any sufficiently rigid material which will not damage the drum surface. Typical materials would be Lexan, Nylon, Teflon, etc. The thickness does not appear to be critical but is preferably as small as possible to reduce the likelihood of image degradation during the sheet stripping step.

Figure 5:
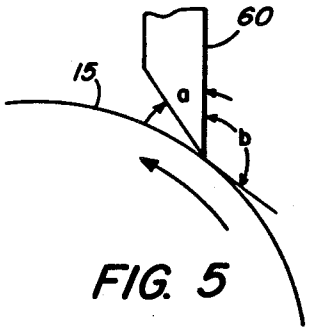
FIG. 5 is an enlarged view of the circled section of FIG. 2.

The stripping element 62 is advantageously placed in a position to contact and lift from the surface 15 a leading edge of a copy sheet at a corner thereof by deflecting the corner from the photosensitive surface and directing it, almost immediately, toward knurled roller 64. (See FIG. 3) The extent of tip 86, angle a in FIG. 5, is preferably about 45°. The position of the tip relative to a tangent at the point of contact, angle b, is preferably about 126.25°.

In typical operation, according to a preferred embodiment of the invention, the knurled roller 64 engages the leading edge of the copy sheet 40 almost immediately after that leading edge is stripped from the photosensitive surface and the leading edge is thereby deflected and directed by the knurled roller into the nip between the knurled roller and the driven rubber roller surface 87. The knurled roller, as noted above, is independently biased against the rubber roller surface and its position relative to the photosensitive surface 15 and the tip 86 is selected so that the leading edge of the stripped copy sheet substantially immediately contacts the roller 64 (FIG. 3). The knurled roller, which is being rotated, in this illustrated embodiment, by the roller 74, directs the copy sheet leading edge not only toward the nip 98 between the rollers 64, 74 but also away from the stripping element 62 (and tip 86) to prevent any disturbance to the image adhering to the underside of the copy sheet. Typically the knurled roller 64 bears against the roller 74 with a force of one to six ounces and is positioned immediately adjacent the surface 15, for example spaced 1/16 inches away therefrom. Thereby, the knurled roller 64 importantly deflects and directs the copy sheet away from the sheet stripping element and into a feed through mechanism whereby the remainder of the paper is pulled off the photosensitive surface and is directed and guided by the knurled rollers 65, 70 and 72. The rollers 65, 70 and 72 effectively direct the copy sheet toward the fixing station and preferably also maintain the copy sheet safely spaced away from an edge 100 of mounting plate 60 (FIG. 4). (Typically roller 65 bears on roller 74 with a force of two to seven ounces; and rollers 70 and 72 are spaced about 0.015 and 0.083 inches respectively from roller 74.) Only the leading edge of the copy sheet should be allowed to contact edge 100 if the fidelity of the image is to remain unimpaired. In this manner, the image adhering to the copy sheet is not disturbed.

In the preferred embodiments rollers 64, 75, 70 and 72 are knurled rollers to prevent damaging the fragile toner image on the copy sheet. In other embodiments of the invention more or fewer rollers can be employed or other moving surfaces for example belts can be employed so long as the moving surface does not disturb the developed image on the copy sheet and so long as the function of roller 64, to substantially immediately deflect and direct the copy sheet away from the stripping element 62, is attained. Similarly roller 74 can be replaced by a belt or other moving surface.

Figure 6:
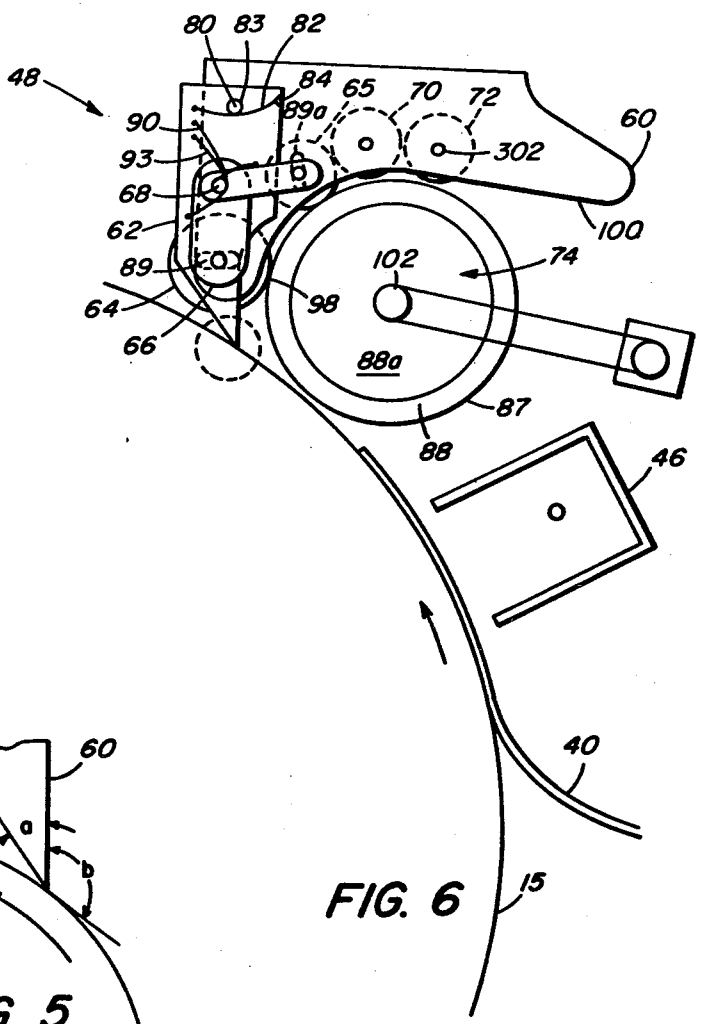
FIG. 6 is an elevation view of the photosensitive surface and sheet stripping apparatus according to a second embodiment of the invention with the copy sheet at the transfer station.

In the embodiment just described, the velocity of the surface 87 of roller 74 is selected to be slightly greater than that of the photosensitive surface of the drum 14. In other embodiments, it is not necessary to rely upon the knurled roller 64 position and surface characteristic to ensure that the copy sheet is deflected away from the sheet stripping member 62. Thus, referring to FIG. 6, in another particular embodiment of the invention, the roller 74 is driven through a slip clutch 102 at an angular speed sufficient to ensure that the peripheral surface 87 has a velocity substantially greater than the velocity of the photosensitive surface. In this manner, the copy sheet tends to wrap more closely around the rubber roller 74 and is directed away from the stripping member 62.

In the illustrated embodiment, one stripping assembly 48 is employed at a marginal edge of the copy sheet for initially detaching and gripping a corner of the copy sheet and directing it along an exit path. In other embodiments, a plurality of assemblies 48 can be employed for example spaced apart along the drum width or for example at opposite marginal portions of the copy sheet.

ADVANTAGES OF THE INVENTION AND NON-OBVIOUSNESS

The sheet stripping apparatus advantageously has a sheet pick-off mechanism for a photocopy apparatus which employs few parts, which is reliable, which avoids paper jams by picking off from the photosensitive surface all sheets thereon, including troublesome so-called "shingled" sheets, and provides an apparatus which is simple to manufacture and install from a technical standpoint and which can use inexpensive materials and which therefore has a low manufacturing cost. In addition, the claimed invention does not mar the image on the sheet, can be used with both liquid and dry developers, and does not rely upon complex timing mechanisms in order to remove the sheet material from the fragile photosensitive surface.

The combination of the resiliently biased stripping element and the closely adjacent deflecting surface (a knurled roller/friction roller nip in the preferred embodiment) provides the mechanism whereby edge image deletion and even small corner area deletion simply need not occur, and wherein, due to the independently adjustable parameters of the system, variable manufacturing parameters of a particular apparatus can be accounted for if necessary, and hence less rigid manufacturing tolerances can be used without sacrificing copy quality.

The various pick-off members shown in the prior art are more complex and typically have not employed a member always resting on the photosensitive drum. The prior art devices, such as U.S. Pat. No. 3,649,115, are typically precisely timed devices having precision mechanical structures to avoid damaging the photosensitive surface. The claimed invention advantageously does not require these generally sophisticated timing mechanisms, for example either cam controlled, or mechanically or electrically actuated, which prior art apparatus employ.

With respect to those prior art devices wherein a mechanical structure is maintained in contact with or resting on the photosensitive drum, there is no device which either provides substantially full copy capability or which advantageously employs a cooperative deflection mechanism to substantially immediately deflect the copy sheet from the sheet stripping member to an exit path. Thus, references such as U.S. Pat. Nos. 3,992,000; 3,885,786; 3,820,776; 3,450,402; 3,578,859; 3,991,999; and 4,072,307, do not disclose the method and apparatus of the present invention.

Additions, subtractions, deletions, and other modifications of the invention will be obvious to those practiced in the art and are within the scope of the following claims.

What is claimed is:

1. In a photocopying apparatus having a movable member having a photosensitive surface, means for forming a developed latent image on said photosensitive surface, means for feeding a copy sheet material for contact with said photosensitive surface at a transfer station for transferring said developed image onto said copy sheet material, and means for removing said copy sheet from said photosensitive surface, the improvement wherein said sheet removing means comprises a sheet stripping element having an operative portion resiliently biased against said photosensitive surface for contacting a leading edge of said copy sheet as it moves toward said sheet stripping element for detaching said leading edge of said copy sheet from said photosensitive surface, a moving roller member deflection surface positioned adjacent said operative portion of said sheet stripping element and moving in a direction, at a closest approach position to the photosensitive surface, opposite to the direction of movement of the photosensitive surface, for substantially immediately deflecting said detached leading edge away from said sheet stripping element and toward an exit path, said moving surface thereby maintaining said copy sheet out of contact with said sheet stripping element, means for driving said moving surface for deflecting said copy sheet material toward said exit path and away from said photosensitive surface, a driven roller member is driving contact with said roller member surface, and a resilient element for biasing the sheet stripping element operative portion toward and in engagement with said photosensitive surface.

2. In a photocopying apparatus having a movable member having a photosensitive surface, means for forming a developed latent image on said photosensitive surface, means for feeding a copy sheet material for contact with said photosensitive surface at a transfer station for transferring said developed image onto said copy sheet material, and means for removing said copy sheet from said photosensitive surface, the improvement wherein said sheet removing means comprises a sheet stripping element having an operative portion resiliently biased against said photosensitive surface for contacting a leading edge of said copy sheet as it moves toward said sheet stripping element for detaching said leading edge of said copy sheet from said photosensitive surface, a moving deflection surface positioned adjacent said operative portion of said sheet stripping element and moving in a direction, at a closest approach position to the photosensitive surface, opposite to the direction of movement of the photosensitive surface, for substantially immediately deflecting said detached leading edge away from said sheet stripping element and toward an exit path, said moving surface thereby maintaining said copy sheet out of contact with said sheet stripping element, means for driving said moving surface for deflecting said copy sheet material toward said exit path and away from said photosensitive surface, a driven surface in driving contact with said moving deflection surface, and wherein said driving means drives said ones of said deflection surface and said driven surface at a velocity greater than the peripheral velocity of said photosensitive surface.

3. The apparatus of claim 2 wherein said driving means comprises a slip element for driving said driven surface at a velocity substantially greater than the velocity of said photosensitive surface.

4. In a photocopying apparatus having a movable member having a photosensitive surface,
means for forming a developed latent image on said photosensitive surface,
means for feeding a copy sheet material for contact with said photosensitive surface at a transfer station for transferring said developing image into said copy sheet material, and
means for removing said copy sheet from said photosensitive surface,
the improvement wherein said sheet removing means comprises
a sheet stripping element having an operative portion resiliently biased against said photosensitive surface for contacting a leading edge of said copy sheet as it moves toward said sheet stripping element for detaching said leading edge of said copy sheet from said photosensitive surface,
a moving deflection surface positioned adjacent said operative portion of said sheet stripping element and moving in a direction, at a closest approach position to the photosensitive surface, opposite to the direction of movement of the photosensitive surface, for substantially immediately deflecting said detached leading edge away from said sheet stripping element and toward an exit path, said moving surfaces thereby maintaining said copy sheet out of contact with said sheet stripping element,
means for driving said moving surface for deflecting said copy sheet material toward said exit path and away from said photosensitive surface, and
a driven surface in contact with said deflection surface,
wherein said driving means drives one of said deflection surface and said driven surface at a velocity substantially greater than the peripheral velocity of the photosensitive surface for removing any slack in said detached copy sheet and at a lower velocity after said slack has been

5. In a photocopying apparatus having
a moving member having a photosensitive surface,
means for forming a developed latent image on said photosensitive surface,
means for feeding a copy sheet material for contact with said photosensitive surface at a transfer station for transferring said developed image onto said copy sheet material, and
means for removing said copy sheet from said photosensitive surface,
the improvement wherein said sheet removing means comprises
a sheet stripping element having a tip portion resiliently biased against said photosensitive surface for contacting a leading edge of said copy sheet as it moves toward said sheet stripping element for detaching said leading edge of said copy sheet from said photosensitive surface,
a deflection surface mounted adjacent said tip portion of said sheet stripping element, and moving in a direction, at a closest approach position to the photosensitive surface, opposite to the direction of movement of said photosensitive surface, for deflecting said detached leading edge away from said sheet stripping element and toward a nip formed by said deflection surface and a movable friction surface, and
means for driving at least one of said deflection surface and said moving friction surface for passing said copy sheet material through the nip therebetween and directing it toward an exit path away from said photosensitive surface,
wherein said deflection surface is the surface of a rotating deflection roller.

6. In a photocopying apparatus having a moving member having a photosensitive surface,
means for forming a developed latent image on said photosensitive surface,
means for feeding a copy sheet material for contact with said photosensitive surface at a transfer station for transferring said developed image onto said copy sheet material, and
means for removing said copy sheet from said photosensitive surface,
the improvement wherein said sheet removing means comprises
a sheet stripping element having a tip portion resiliently biased against said photosensitive surface for contacting a leading edge of said copy sheet as it moves toward said sheet stripping element for detaching said leading edge of said copy sheet from said photosensitive surface,
a rotating knurled roller having a deflection surface mounted adjacent said tip portion of said sheet stripping element for deflecting said detached leading edge away from said sheet stripping element and toward a nip formed by said deflection surface and a movable friction surface of a driven roller member,
means for driving at least one of said deflection surface and said moving friction surface for passing said copy sheet material through the nip therebetween and directing it toward an exit path away from said photosensitive surface, and
first and second resilient elements for biasing respectively the sheet stripping element tip toward said photosensitive surface and said knurled roller toward said friction surface.

7. The apparatus of claim 6 further comprising
a second knurled roller,
means for mounting said sheet stripping element and said first and second knurled rollers, and
third resilient means for biasing said second knurled roller toward said friction surface, said second roller guiding said copy sheet material from said nip along said exit path.

8. In a photocopying apparatus having a moving member having a photosensitive surface,
means for forming a developed latent image on said photosensitive surface,
means for feeding a copy sheet material for contact with said photosensitive surface at a transfer station for transferring said developed image onto said copy sheet material, and
means for removing said copy sheet from said photosensitive surface,
the improvement wherein said sheet removing means comprises
a sheet stripping element having a tip portion resiliently biased against said photosensitive surface for contacting a leading edge of said copy sheet as it moves toward said sheet stripping element for detaching said leading edge of said copy sheet from said photosensitive surface,
a rotating deflection roller having a deflection surface mounted adjacent said tip portion of said sheet stripping element for deflecting said detached leading edge away from said sheet stripping element and toward a nip formed by said deflection surface and a movable friction surface, means for driving at least one of said deflection surface and said moving friction surface for passing said copy sheet material through the nip therebetween and directing it toward an exit path away from said photosensitive surface, and said driving means drives said at least one of said deflection surface and said friction surface at a velocity greater than the peripheral velocity of said photosensitive surface.

9. The apparatus of claim 8 wherein said driving means includes a slip drive member for driving movement of said friction surface at a velocity substantially greater than the velocity of said photosensitive surface.

10. In a photocopying apparatus having a moving member having a photosensitive surface, means for forming a developed latent image on said photosensitive surface, means for feeding a copy sheet material for contact with said photosensitive surface at a transfer station for transferring said developed image onto said copy sheet material, and means for removing said copy sheet from said photosensitive surface, the improvement wherein said sheet removing means comprises a sheet stripping element having a tip portion resiliently biased against said photosensitive surface for contacting a leading edge of said copy sheet as it moves toward said sheet stripping element for detaching said leading edge of said copy sheet from said photosensitive surface, a rotating deflection roller having a deflection surface mounted adjacent said tip portion of said sheet stripping element for deflecting said detached leading edge away from said sheet stripping element and toward a nip formed by said deflection surface and a movable friction surface, means for driving at least one of said deflection surface and said moving friction surface for passing said copy sheet material through the nip therebetween and directing it toward an exit path away from said photosensitive surface, and said driving means drives one of said deflection surface and said friction surface at a velocity substantially greater than the peripheral velocity of the photosensitive surface for removing any slack in said detached copy sheet and at lower velocity after said slack has been removed.

11. The apparatus of claim 6 further comprising a third and fourth knurled rollers, wherein said third and fourth knurled rollers are spaced apart from said driven roller for further guiding said copy sheet along the exit path.

12. In a photocopying apparatus having a movable member having a photosensitive surface, means for forming a developed latent image on said photosensitive surface, means for feeding a copy sheet material for contact with said photosensitive surface at a transfer station for transferring said developed image onto said copy sheet material, and means for removing said copy sheet from said photosensitive surface, the improvement wherein said sheet removing means comprises a sheet stripping element having a tip portion resiliently biased against said photosensitive surface for contacting a leading edge of said copy sheet as it moves toward said sheet stripping element for detaching said leading edge of said copy sheet from said photosensitive surface, a rotatable knurled roller having a knurled surface adjacent a tip portion of said sheet stripping element for substantially immediately deflecting said detached leading edge away from said sheet stripping element, said knurled surface thereby maintaining said copy sheet out of contact with said sheet stripping element, a roller member having a friction surface in juxtaposition to the knurled surface for gripping in cooperation with said knurled surface the deflected leading edge of the copy sheet and for guiding said leading edge along an exit path, and means for rotating said roller member at a velocity sufficient to prevent marring of the developed image on said copy sheet.

13. The apparatus of claim 12 further comprising first and second resilient elements for biasing respectively the sheet stripping element tip portion toward said photosensitive surface and said knurled roller toward said roller member.

14. The apparatus of claim 13 wherein said driving means drives said roller member at a velocity greater than the peripheral velocity of said photosensitive surface, and further comprising a plurality of copy sheet guiding knurled rollers, each roller being mounted in an operative position opposite said roller member surface.

15. The apparatus of claim 14 wherein there are at least two copy sheet guiding rollers, one of said rollers being resiliently biased into engagement with the surface of said roller member and a second of said rollers being spaced apart out of contact with said roller member surface.

16. The apparatus of claim 13 further comprising means for mounting said sheet removing assembly in the path of a marginal edge of said copy sheet material.

17. The apparatus of claim 13 wherein said sheet stripping element comprises a planar member, and said sheet stripping assembly further comprises means for mounting said planar member in a plane substantially normal to the photosensitive surface.

18. The apparatus of claim 17 wherein said planar member has a mylar composition.

19. A method for removing a copy sheet material from the photosensitive surface of a photocopying apparatus, the photocopying apparatus having means for forming a developed image on the photosensitive surface, means for feeding a copy sheet material for contact with the photosensitive surface at a transfer station for transferring the developed image onto the copy sheet material, and means for removing the copy sheet material from the photosensitive member, the method comprising the steps of resiliently biasing a sheet stripping element at a tip portion against the photosensitive surface for contacting a leading edge of the copy sheet as it moves toward the sheet stripping element, detaching a leading edge of the copy sheet from the photosensitive surface using the tip portion of the sheet stripping element, deflecting substantially immediately and maintaining the detached leading edge of the sheet material away from the sheet stripping element and along an exit path, and driving a moving deflection surface for deflecting the copy sheet material away from the photosensitive surface and the stripping member and toward the exit path, said driving step comprising driving said deflection surface by a contacting driven surface, said deflection surface and said driven surface forming a nip for receiving said copy sheet, and driving said driven surface at a velocity greater than the velocity of said photosensitive surface.

* * * * *